US011564483B2

(12) United States Patent
Zheng

(10) Patent No.: US 11,564,483 B2
(45) Date of Patent: Jan. 31, 2023

(54) HEIGHT-ADJUSTABLE DESK

(71) Applicant: NINGBO INTECH SMART TECHNOLOGY CO., LTD, Ningbo (CN)

(72) Inventor: Bisheng Zheng, Ningbo (CN)

(73) Assignee: NINGBO INTECH SMART TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/403,900

(22) Filed: Aug. 17, 2021

(65) Prior Publication Data

US 2022/0295982 A1 Sep. 22, 2022

(30) Foreign Application Priority Data

Mar. 18, 2021 (CN) ..... 202120563579.8

(51) Int. Cl.
*A47B 9/16* (2006.01)
*A47B 21/02* (2006.01)
*A47B 9/10* (2006.01)

(52) U.S. Cl.
CPC ..... *A47B 9/16* (2013.01); *A47B 9/10* (2013.01); *A47B 21/02* (2013.01)

(58) Field of Classification Search
CPC ..... A47B 1/03; A47B 21/0314; A47B 21/00; A47B 21/02; A47B 21/03; A47B 9/16; A47B 9/10; A47B 2021/0321; A47B 2021/0364; A47B 3/02; A47B 3/0809; A47B 3/0815; A47B 2003/025; A47B 3/00; A47B 61/00
USPC ..... 108/144.11, 147, 145, 93, 96, 116–118, 108/120, 43, 138, 50.01, 50.02; 312/208.1, 223.3; 248/421, 562, 588, 248/585, 431, 432, 439
See application file for complete search history.

(56) References Cited

U.S. PATENT DOCUMENTS 4,741,512 A * 5/1988 Elkuch ..... B66F 7/065 D34/28
5,926,876 A * 7/1999 Haigh ..... A61G 13/12 5/616

(Continued)

FOREIGN PATENT DOCUMENTS

CN 103422335 * 12/2013
CN 206565534 * 10/2017

(Continued)

*Primary Examiner* — Janet M Wilkens
(74) *Attorney, Agent, or Firm* — Bayramoglu Law Offices LLC

(57) ABSTRACT

A height-adjustable desk includes a desk board and a base. Two first lifting arms and one second lifting arm are disposed between the desk board and the base. The two first lifting arms are disposed at both sides of the desk board respectively. The second lifting arm is located between the two first lifting arms and spatially intersected with the two first lifting arms to be distributed in an X shape. The upper ends of the two first lifting arms are rotatably connected to a first end of the desk board, and the lower ends of the two first lifting arms are slidably connected to a first end of the base. The upper end of the second lifting arm is slidably connected to a second end of the desk board, and and the lower end of the second lifting arm is hinged to a second end of the base.

11 Claims, 4 Drawing Sheets

(56) References Cited

U.S. PATENT DOCUMENTS

| | | | | |
|---|---|---|---|---|
| 9,815,672 | B2 * | 11/2017 | Baudermann | B66F 9/122 |
| 10,244,861 | B1 * | 4/2019 | Poniatowski | A47B 9/16 |
| 10,258,148 | B1 * | 4/2019 | Donner | A47B 17/02 |
| 10,258,149 | B2 * | 4/2019 | Zhong | A47B 9/16 |
| D854,775 | S * | 7/2019 | Chang | D34/28 |
| 10,499,730 | B2 * | 12/2019 | Kim | A47B 21/02 |
| 11,109,671 | B1 * | 9/2021 | Liu | A47B 9/02 |
| 11,134,773 | B1 * | 10/2021 | Poniatowski | A47B 21/04 |
| 2021/0269295 | A1 * | 9/2021 | Chesbrough | B66F 11/042 |

FOREIGN PATENT DOCUMENTS

| | | | |
|---|---|---|---|
| CN | 214855133 | * | 11/2021 |
| FR | 3078614 | * | 9/2019 |

* cited by examiner

X

HEIGHT-ADJUSTABLE DESK

CROSS REFERENCE TO THE RELATED APPLICATIONS

This application is based upon and claims priority to Chinese Patent Application No. 202120563579.8, filed on Mar. 18, 2021, the entire contents of which are incorporated herein by reference.

TECHNICAL FIELD

The present invention relates to the field of computer bearing technologies, and in particular to a height-adjustable desk.

BACKGROUND

In the prior art, office desks always have fixed heights. However, different users or different use conditions may require that desktop should be at different heights for ease of use. For example, users may have different requirements for the desktop heights of office desks due to different heights of user body and computer chairs.

In the prior art, a patent document discloses a desktop placement type height-adjustable desk, comprising a working platform, an upper support seat and a lower support seat. A first lifting arm and a second lifting arm are disposed between the upper support seats and the lower support seats and intersected in an X shape and hinged at an intersection, an upper end of the first lifting arm is hinged with the upper support seat and a lower end of the first lifting arm is slidably mated with the lower support seat, a lower end of the second lifting arm is hinged with the lower support seat and an upper end of the second lifting arm is slidably mated with the upper support seat. A gas spring is disposed between the upper support seat and the lower support seat to provide a drive force for lifting the upper support seat.

In the above patent document, the gas spring, as a lifting power source is mounted between the upper support seat and the lower support seat. The upper support seat is a component additionally mounted at a bottom surface of the working platform, an upper end of the gas spring is connected with the upper support seat, and a lower end of the gas spring is actually mounted on the first lifting arm or the second lifting arm. Further, a dual X-shaped lifting supporting structure is formed by using two first lifting arms and two second lifting arms, leading to complex overall structure and large weight. In addition, due to existence of the upper support seats, it is difficult to achieve an optimal overall height when the height-adjustable desk is in a storage state, thereby consuming more consumable materials in product packaging and bringing high costs.

SUMMARY

To solve the technical problems and overcome the defects of the prior art, the present invention provides a height-adjustable desk that is simple in structure, light in weight, convenient to mount, and stable to lift.

The technical solution of the present invention is to provide a height-adjustable desk. The height-adjustable desk comprises a desk board and a base, two first lifting arms and one second lifting arm for adjusting a height of the desk board are disposed between the desk board and the base, the two first lifting arms are disposed at both sides of the height-adjustable desk respectively, and the second lifting arm is located between the two first lifting arms and spatially intersected with the two first lifting arms to be distributed in an X shape. The second lifting arm is hinged with at least one first lifting arm at the X-shaped intersection overlapping position, a gas spring for providing a drive force for lifting the desk board is disposed between the second lifting arm and the desk board, and a lever for controlling the operation of the gas spring is disposed on the desk board.

Compared with the prior art, the present invention has the following advantages.

Compared with the traditional height-adjustable desk, the structure of the present invention is provided with two first lifting arms and one second lifting arm, and the second lifting arm is located between the two first lifting arms and intersected with the two first lifting arms to be distributed in the X shape. With such disposal, the desk board can be effectively supported and one lifting arm is omitted, thereby greatly reducing the weight of the height-adjustable desk. Further, both ends of the gas spring in this structure are connected to the desk board and the second lifting arm respectively, so that the overall structure is simpler and more convenient to mount. Further, the upper end of the gas spring in this structure can also achieve a certain supporting effect for the desk board, thereby ensuring the use stability of the desk board.

Furthermore, one end of the gas spring is hinged with the second lifting arm, and the other end of the gas spring is connected to a bottom surface of the desk board. In this structure, the upper end of the gas spring is mounted at the bottom surface of the desk board through a mounting plate, and the lower end of the gas spring is directly hinged on the second lifting arm, and thus, the structure is simple and convenient to mount; further, the gas spring supported at the bottom surface of the desk board is equivalent to serving as a supporting leg to ensure the stability of the desk board.

Further, a U-shaped mounting plate is disposed at the bottom surface of the desk board, a U-shaped groove bottom of the mounting plate is a flat surface that is attached and fixedly connected to the bottom surface of the desk board; two lugs are disposed at side walls of the mounting plate, a connection shaft is disposed between the two lugs, and the upper end of the gas spring is rotatably connected with the connection shaft. With this structure, the gas spring is connected on the desk board more conveniently and the U-shaped groove bottom helps the mounting, and the side walls of the mounting plate can increase the structural strength. The upper end of the gas spring is connected on the lugs through the connection shaft, so that the gas spring will not contact with the U-shaped groove bottom during rotation relative to the connection shaft, thus producing no noise.

Further, the U-shaped groove bottom of the mounting plate is a rectangle with fastening screws arranged along a length direction, and the fastening screws are fixed at the bottom surface of the desk board. This structure effectively enhances the connection strength of the mounting plate and the desk board.

Preferably, the mounting plate is fixed at a middle position of a side of the desk board. In this structure, the upper end of the gas spring connected with the desk board also serves as a supporting column, thereby effectively ensuring the stability of the desk board.

In a further improvement, the lower end of the gas spring is hinged at a side wall of the second lifting arm, and a distance from the hinging point to a hinging point connecting the lower end of the second lifting arm and the base is greater than a length of the gas spring in a retracted state. Such disposal aims to further lower the overall height of the height-adjustable desk in a storage state, thus reducing a packaging volume and lowering the costs.

In an improvement, when looking up at the height-adjustable desk, projections of the three lifting arms on the desk board are parallel to one another, and the projection of the second lifting arm on the desk board is located in the exact middle of the projections of the two first lifting arms. With this improved structure, the height-adjustable desk can be adjusted stably in height, and have a beautiful appearance.

In a further improvement, a hinging shaft is horizontally and slidably penetrated through the X-shaped intersection overlapping position of the second lifting arm, and both ends of the hinging shaft are hinged with the two first lifting arms respectively. With this improved structure, the second lifting arm and the two first lifting arms can ascend or descend more synchronously and stably.

A surface of the second lifting arm facing toward the desk board is an upper surface of the second lifting arm, and two side surfaces penetrated by the hinging shaft are side walls.

In a further improvement, a limiting sleeve is sleeved on the hinging shaft. In this improved structure, the limiting sleeve effectively limits a distance between the second lifting arm and the two first lifting arms. Therefore, the structure is easy to mount and different lifting arms are more stable during height adjustment.

In a further improvement, a connection cross rod is disposed between the lower ends of the two first lifting arms. With this improved structure, the lower ends of the two first lifting arms are synchronized, and the overall lifting structure is more stable. Therefore, the structure is smoother when supporting the desk board.

Numerals of the drawings are described as follows:

1—desk board, 2—base, 2.1—transverse rod, 2.2—longitudinal rod, 3—first lifting arm, 4—second lifting arm, 5—gas spring, 6—lever, 7—supporting board, 8—hinging shaft, 9—limiting sleeve, 10—first guiding slide rail, 11—first slide block, 12—second guiding slide rail, 13—second slide block, 14—connection cross rod, 15—transverse supporting rod, 16—mounting plate, 16.1—lug, 17—connection shaft, 18—fastening screw, and 19—hinging seat.

DETAILED DESCRIPTION OF THE EMBODIMENTS

The present invention is further described below in combination with accompanying drawings and specific embodiments.

Figure 3:
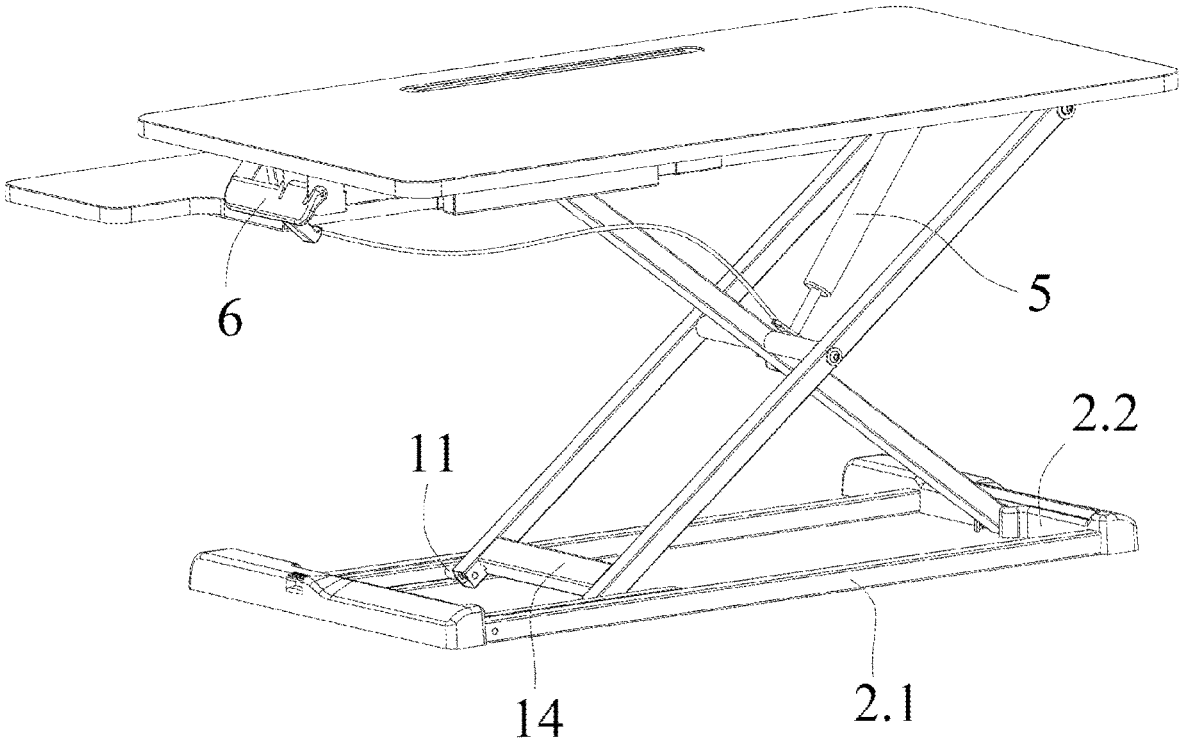
FIG. 3 is a structural schematic diagram of a height-adjustable desk at a third angle according to an embodiment of the present invention.

In the descriptions of the present invention, it is to be noted that orientations or positional relationships indicated by the terms such as "upper end" and "lower end" are based on orientations or positional relationships shown in FIG. 3, and are used only for ease of descriptions of the present invention and simplification of descriptions rather than indicating or implying that the indicated devices or elements must have a particular orientation, or be constructed or operated in a particular orientation. Therefore, such terms shall not be understood as limiting of the present invention. In addition, it is to be noted that the terms "first" and "second" are used only for descriptions and shall not be understood as indicating or implying relative importance.

In the descriptions of the present invention, it is to be noted that unless otherwise clearly stated or defined, the term "connect" shall be understood in a broad sense, for example, may be fixed connection, or detachable connection, or formed into one piece; or may be mechanical connection, or electrical connection; or direct connection or indirect connection through an intermediate medium, or may be internal communication between two elements. Those of ordinary skill in the art may understand the specific meanings of the above terms in the present invention according to actual situations.

Figure 1:
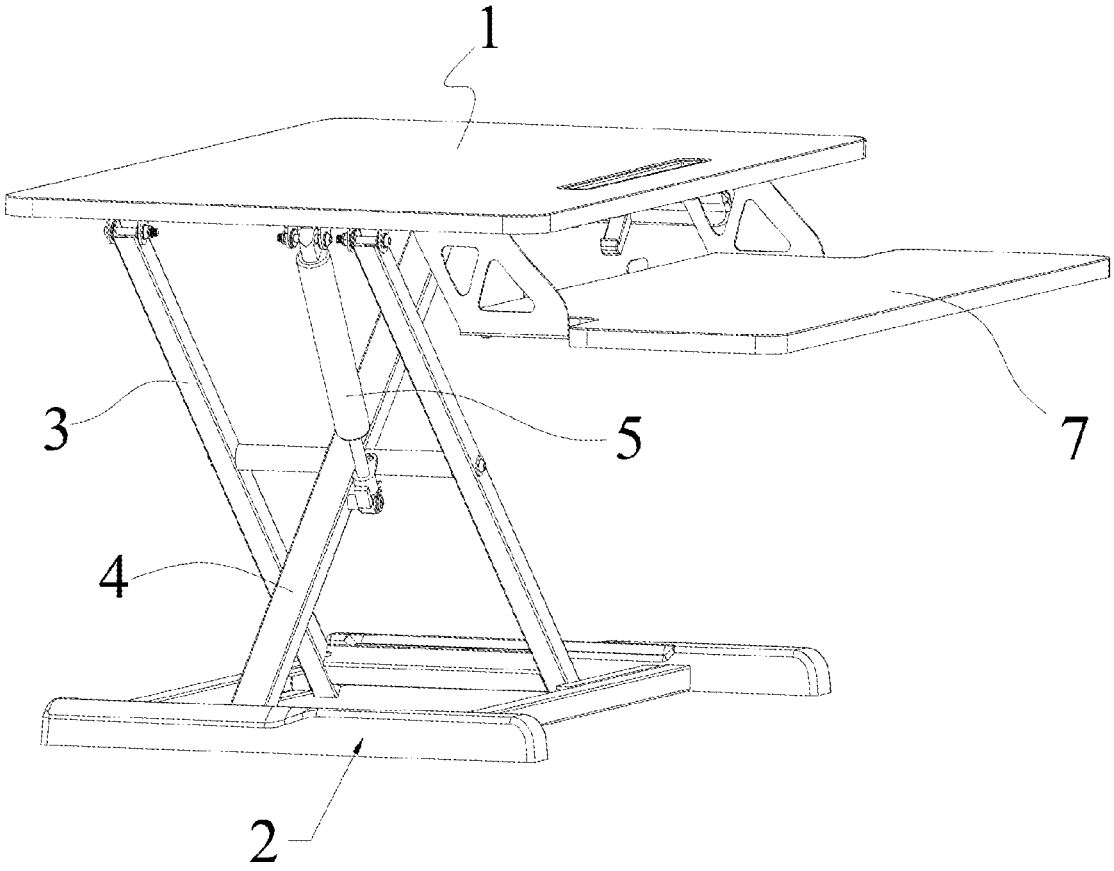
FIG. 1 is a structural schematic diagram of a height-adjustable desk at a first angle according to an embodiment of the present invention.

As shown in FIG. 1 and FIG. 3, the present invention provides a height-adjustable desk. In a first embodiment, the height-adjustable desk comprises a desk board 1 and a base 2. The desk board 1 is a rectangular board located above the base. In addition, the base 2 in this structure is basically a rectangular frame. Specifically, the base 2 is assembled by two transverse rods 2.1 and two longitudinal rods 2.2. In this embodiment, each of the transverse rods 2.1 and the longitudinal rods 2.2 is a hollow square-pipe structure, so that a bottom surface of the assembled frame is in a same horizontal plane, thereby stably supporting the entire height-adjustable desk during use. Further, the hollow structure can effectively reduce weight. In this structure, the transverse direction refers to a length direction of the rectangular base 2, and the longitudinal direction refers to a width direction of the rectangular base 2.

In another aspect, in the structure of the embodiment, two first lifting arms 3 and one second lifting arm 4 for adjusting the height of the desk board 1 are disposed between the desk board 1 and the base 2. Further, looking up at the height-adjustable desk, the two first lifting arms 3 are projected at both sides of the desk board 1 respectively, and the projection of the second lifting arm 4 is between the projections of the two first lifting arms 3. The two first lifting arms 3 are in a same plane, and the second lifting arm is intersected with the plane to present an X-shaped distribution. Further, preferably, when looking up at this structure, the projections of the three lifting arms on the desk board are parallel to one another; at this time, the overall lifting structure is more stable, adjusted in height more flexibly, and has a beautiful appearance.

In this embodiment, in a case of looking up, the projection of the second lifting arm 4 is located in the exact middle of the projections of the two first lifting arms 3, and each pair of the projections of the three lifting arms are parallel to each other. A hinging shaft 8 is horizontally and slidably penetrated through an X-shaped intersection overlapping position of the second lifting arm 4, and both ends of the hinging shaft 8 are hinged with the two first lifting arms 3 respectively. A lifting sleeve 9 is sleeved on the hinging shaft 8 to effectively limit a distance between the second lifting arm 4 and the two first lifting arms 3. Further, the limiting sleeve is easy to mount. In this case, each lifting arm is more stable during height adjustment. In this structure, the first lifting arms 3 and the second lifting arm 4 are all hollow square-pipe structures.

In other embodiments, the hinging shaft 8 herein may also be divided into two parts, that is, one short connection shaft is hinged between both sides of the second lifting arm 4 and the two first lifting arms 3 respectively. In this structure, different lifting arms may be limited without adding the limiting sleeve 9.

Figure 2:
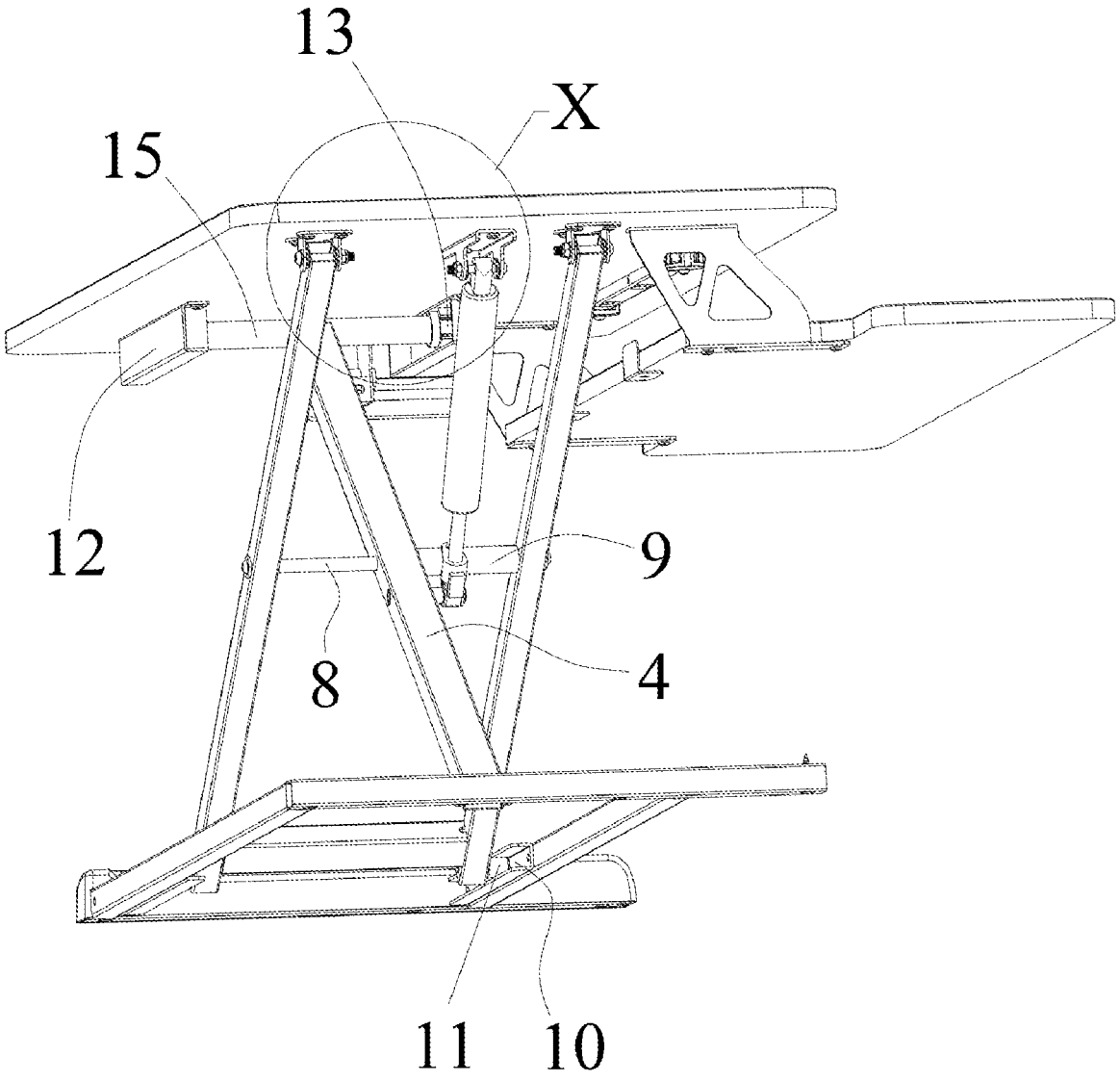
FIG. 2 is a structural schematic diagram of a height-adjustable desk at a second angle according to an embodiment of the present invention.
Figure 4:
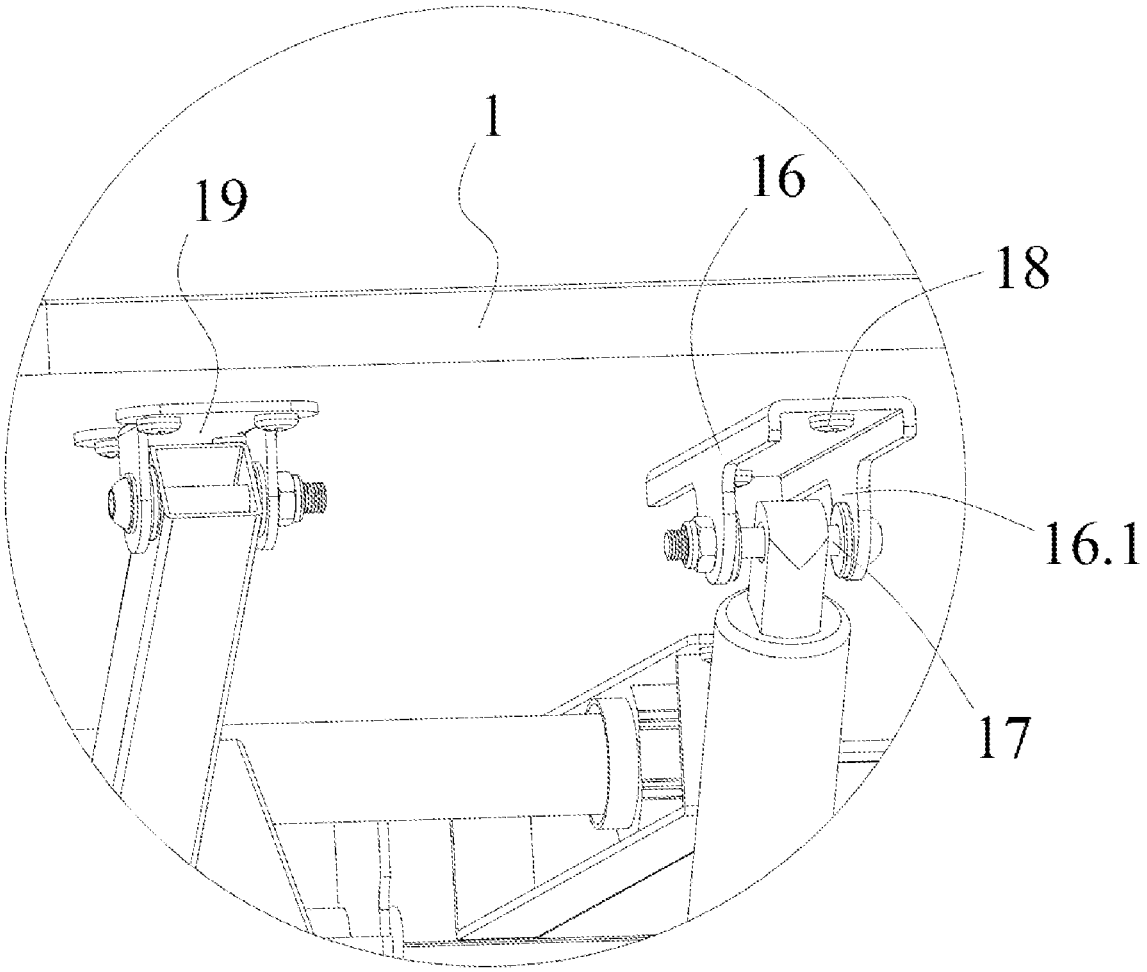
FIG. 4 is a partial enlarged view of a height-adjustable desk according to an embodiment of the present invention.

In the first embodiment, upper ends of the two first lifting arms 3 are connected to one side of the desk board 1. Specifically, as shown in FIG. 4, a corresponding hinging seat 19 is disposed at a bottom surface of the desk board 1, and comprises a horizontal mounting plate. The horizontal mounting plate is fixed at the bottom surface of the desk board 1 by four screws, and two convex plates are disposed at both sides of the horizontal mounting plate, and a rotary shaft is disposed between two convex plates. During mounting, the rotary shaft is movably penetrated through an upper end wall of the first lifting arm 3 to realize a rotatable connection between the first lifting arm 3 and the desk board 1. At the same time, a lower end of the first lifting arm 3 is slidably connected to one end of the base 2, where the slidable connection herein refers to that first guiding slide rails 10 are disposed on side walls of two transverse rods 2.1 facing toward the interior of the frame of the base respectively, and the lower ends of the two first lifting arms 3 are convexly hinged with first slide blocks 11 slidably cooperating with the first guiding slide rails 10 respectively, as shown in FIG. 2 and FIG. 3. In this structure, the first guiding slide rail 10 is of a U-shaped groove structure, and the two U-shaped grooves open toward the center of the rectangular frame respectively, thereby forming two slideways. The first slide block 11 in this structure may be of a rectangular block or roller structure. When the first slide block 11 is of the roller structure, the slide block receives a smaller rolling friction during sliding; when the first slide block 11 is of the rectangular block structure, the slide block receives a larger frictional force, but the sliding is relatively more stable.

In addition, an upper end of the second lifting arm 4 is slidably connected to the other side of the desk board 1, and a lower end of the second lifting arm 4 is hinged with the other end of the base 2, where the slidable connection herein refers to that two second guiding slide rails 12 parallel to the first guiding slide rails are disposed at a left-right interval on the bottom surface of the desk board 1, second slide blocks 13 slidably cooperate with the second guiding slide rails 12, and both sides of the upper end of the second lifting arm 4 are rotatably connected relative to the second slide blocks 13 respectively, as shown in FIG. 2. Specifically, as shown in FIG. 2, a transverse supporting rod 15 is connected at the upper end of the second lifting arm 4, and the two second slide blocks 13 are connected at both ends of the transverse supporting rod 15 respectively. Similarly, the second slide block 13 in this structure may be of a square block or roller structure.

Seen from the entire lifting structure, after continuous tests are performed for the embodiment, the two second slide blocks 13 are selected as square block structure, and the two first slide blocks 11 are selected as the roller structure. With such disposal, when the desk board ascends, the sliding between the lower ends of the two first lifting arms 3 and the base 2 is more flexible, and the sliding between the upper end of the second lifting arm 4 and the desk board 1 is more stable. Thus, this structure achieves the optimal comprehensive effect.

In other embodiments, two first lifting arms 3 may also be configured such that the lower ends are hinged with the base 2, and the upper ends are slidably connected with the desk board 1. The slidable connection has the same structure as the above slide rails, which will not be repeated herein. Similarly, the second lifting arm 4 may be configured such that the upper end is hinged with the desk board 1, and the lower end is slidably connected with the base 2, as long as the height of the desk board 1 can be flexibly adjusted.

More importantly, the second lifting arm 4 is hinged with at least one first lifting arm 3 at the X-shaped intersection overlapping position, a gas spring 5 for providing a drive force for lifting the desk board 1 is disposed between the second lifting arm 4 and the desk board 1, and a lever 6 capable of opening or closing a valve of the gas spring 5 through a brake line is disposed on the desk board 1. The gas spring 5 can be easily extended or retracted by pulling the lever 6, thereby ascending or descending the desk board. Certainly, the lever 6 herein is not limited to being mounted on the desk board 1, and may also be mounted on another component.

Specifically, as shown in FIG. 2 and FIG. 4, in the first embodiment, a U-shaped mounting plate 16 is disposed at the bottom surface of the desk board 1, a U-shaped groove bottom of the mounting plate is a flat surface that is attached and fixedly connected to the bottom surface of the desk board; two lugs 16.1 are disposed at side walls of the mounting plate, a connection shaft 17 is disposed between the two lugs 16.1, and the upper end of the gas spring 5 is rotatably connected with the connection shaft 17. The U-shaped groove bottom of the mounting plate 16 is a rectangle with fastening screws 18 arranged along a length direction of the rectangle, and the fastening screws 18 are fixed on the bottom surface of the desk board 1. In this structure, a force produced by extension and retraction of the gas spring 5 is transmitted to the desk board 1 via the U-shaped mounting plate 16, and the desk board 1 receives the force along the length direction of the U-shaped groove bottom of the U-shaped mounting plate. Therefore, the mounting direction of the mounting plate 16 and the disposal of several fastening screws 18 can effectively ensure connection strength between the mounting plate 16 and the desk board 1, as well as the sturdiness of the mounting plate 16 and other connection structures during the extension and retraction of the gas spring 5.

More specifically, in the structure of the embodiment, the connection shaft 17 is a bolt. When mounted, the bolt is sequentially penetrated through one lug 16.1, a connection hole at the upper end of the gas spring 5, and the other lug 16.1, and then screwed with a fastening nut at the penetrating end of the bolt. With such connection, mounting and dismounting of the connection structure become very convenient.

In this embodiment, the lower end of the gas spring 5 is hinged with the second lifting arm 4, and the upper end of the gas spring 5 is rotatably connected to the bottom surface of the desk board 1 through the mounting plate 16. Specifically, the mounting plate 16 is fixed at a middle position of a side of the desk board to ensure stable ascent or descent of the desk board 1 when the gas spring 5 is driven to extend or retract. More importantly, in this embodiment, the upper end of the gas spring 5 and the upper ends of the first lifting arms 3 are all rotatably connected to the bottom surface of the desk board 1 by use of light and individual connection pieces without disposing other reinforcing plates at the bottom surface of the desk board 1. In this way, the weight is reduced and the overall structure is more convenient to process and mount. Further, such disposal can further lower the minimum height of the height-adjustable desk in a storage state, thus reducing the packaging size and lowering the costs.

As shown in FIG. 3, the first end of the gas spring 5 is hinged at a side wall of the second lifting arm 4 at a first hinging point, and a distance from the first hinging point to a second hinging point is greater than a length of the gas spring 5 in a retracted state, where the second hinging point connects the lower end of the second lifting arm and the base. With such disposal, when the height-adjustable desk is in the storage state, the gas spring 5 is located at a side of the second lifting arm 4 and parallel to the second lifting arm 4, and also located between the hinging shaft 8 and the longitudinal rod 2.2 of the base 2. Thus, the position of each component in storage is more reasonable. Compared with a case that the gas spring 5 is directly hinged at the upper surface of the second lifting arm 4, this structure can further reduce the entire storage height of the height-adjustable desk.

In this embodiment, a connection cross rod 14 is disposed between the lower ends of the two first lifting arms 3, and the connection cross rod 14 is not coaxial with the two first slide blocks 11. In this structure, the connection cross rod 14 is disposed to enhance the connection structure between two first lifting arms 3, so that the lower ends of the two first lifting arms slide synchronously to enable more stable sliding. Further, in this structure, the hinging shaft between the two first slide blocks 11 and the two first lifting arms 3 is shorter and more convenient to mount. Generally, in the existing height-adjustable desk structure, one long shaft is directly disposed at the lower ends of the two first lifting arms 3, both ends of the long shaft penetrate through the two first lifting arms 3 respectively, and the slide blocks are directly mounted at both ends of the long shaft penetrating out of the two first lifting arms 3. In this structure, the distance between the two first lifting arms 3 is not defined, so that the lifting structure has poor stability and is cumbersome to mount.

In this embodiment, as shown in FIG. 1, a supporting board 7 is also disposed at a side of the desk board 1 to place a keyboard. Further, a height of the supporting board 7 is smaller than a height of the desk board 1, one end of the supporting board 7 is connected with the desk board 1, and the other end of the supporting board 7 extends out of the desk board 1. This structure facilitates use of the keyboard. More specifically, the supporting board 7 in this structure may be directly fixedly connected on the desk board 1 with fasteners, or may be detachably connected onto the desk board 1 through a corresponding insertion assembly.

In this embodiment, elastic plastic housings are sleeved on the two longitudinal rods 2.2 respectively, and an upper surface of the plastic housing is entirely higher than upper surfaces of two transverse rods 2.1. With such disposal, when the height-adjustable desk is in the storage state, the lifting arms will finally be in contact with the upper surfaces of the plastic housings to realize vibration reduction and noise reduction.

The above descriptions are made to the preferred embodiments of the present invention but shall not be understood as limiting of the claims. The present invention is not limited to the above embodiments and the specific structures are allowed to change. Various changes made within the scope of protection claimed by the independent claims of the present invention shall all fall within the scope of protection of the present invention.

What is claimed is:

1. A height-adjustable desk, comprising a desk board and a base, wherein two first lifting arms and one second lifting arm for adjusting a height of the desk board are disposed between the desk board and the base;

the two first lifting arms are disposed at both sides of the desk board respectively;

the second lifting arm is located between the two first lifting arms and spatially intersected with the two first lifting arms to be distributed in an X shape;

the second lifting arm is rotatably connected to at least one first lifting arm of the two first lifting arms at an X-shaped intersection overlapping position;

a gas spring for providing a drive force for lifting the desk board is disposed between the second lifting arm and the desk board;

a first end of the gas spring is rotatably connected to the second lifting arm;

a U-shaped mounting plate is disposed at the bottom surface of the desk board;

a U-shaped groove bottom of the U-shaped mounting plate is a flat surface, wherein the U-shaped groove bottom is attached and fixedly connected to the bottom surface of the desk board;

two connecting lugs are disposed at side walls of the U-shaped mounting plate;

a connecting shaft is disposed between the two connecting lugs; and the second end of the gas spring is rotatably connected to the connection shaft, wherein the second end of the gas spring is away from the second lifting arm.

2. The height-adjustable desk of claim 1, wherein the U-shaped groove bottom of the U-shaped mounting plate is a rectangle with fastening screws arranged along a length direction, and the fastening screws are fixed at the bottom surface of the desk board.

3. The height-adjustable desk of claim 2, wherein the U-shaped mounting plate is fixed at a middle position of a side of the desk board.

4. The height-adjustable desk of claim 1, wherein the U-shaped mounting plate is fixed at a middle position of a side of the desk board.

5. The height-adjustable desk of claim 1, wherein the first end of the gas spring is hinged at a side wall of the second lifting arm at a first hinging point, and a distance from the first hinging point to a second hinging point is greater than a length of the gas spring in a retracted state, wherein the second hinging point connects a lower end of the second lifting arm and the base.

6. The height-adjustable desk of claim 1, wherein the second lifting arm is located in an exact middle of the two first lifting arms, and the second lifting arm is parallel to a plane, wherein the two first lifting arms are located on the plane.

7. The height-adjustable desk of claim 6, wherein a hinging shaft is horizontally and slidably penetrated through the X-shaped intersection overlapping position of the second lifting arm, and both ends of the hinging shaft are rotatably connected to the two first lifting arms respectively.

8. The height-adjustable desk of claim 1, wherein a hinging shaft is horizontally and slidably penetrated through the X-shaped intersection overlapping position of the second lifting arm, and both ends of the hinging shaft are rotatably connected to the two first lifting arms respectively.

9. The height-adjustable desk of claim 8, wherein a limiting sleeve is sleeved on the hinging shaft.

10. The height-adjustable desk of claim 1, wherein a connection cross rod is disposed between lower ends of the two first lifting arms.

11. The height-adjustable desk of claim 1, wherein the base is a rectangular frame assembled by two transverse rods and two longitudinal rods, wherein each of the two transverse rods and the two longitudinal rods is a hollow square-pipe structure for a bottom surface of the rectangular frame to be in a same horizontal plane to stably support the height-adjustable desk and to reduce a weight.

* * * * *